US007234400B2

(12) United States Patent
Winter et al.

(10) Patent No.: US 7,234,400 B2
(45) Date of Patent: Jun. 26, 2007

(54) CRANE TROLLEY WITH LOW OVERALL HEIGHT

(75) Inventors: Klaus-Jürgen Winter, Wetter (DE); Michael Dammer, Wetter (DE); Heinrich Flaig, Bochum (DE); Erik Appel, Wetter (DE)

(73) Assignee: Demag Cranes & Components GmbH, Wetter (DE)

( * ) Notice: Subject to any disclaimer, the term of this patent is extended or adjusted under 35 U.S.C. 154(b) by 0 days.

(21) Appl. No.: 10/945,583

(22) Filed: Sep. 21, 2004

(65) Prior Publication Data

US 2005/0092201 A1 May 5, 2005

(30) Foreign Application Priority Data

Sep. 26, 2003 (DE) ..... 103 45 102

(51) Int. Cl.
*B61B 3/00* (2006.01)

(52) U.S. Cl. ..... 104/98

(58) Field of Classification Search ..... 104/89, 104/90, 91, 96, 98, 106, 111
See application file for complete search history.

(56) References Cited

U.S. PATENT DOCUMENTS 3,074,354 A 1/1963 Wakkila
3,212,455 A * 10/1965 Workman ..... 105/155
3,353,503 A 11/1967 Pettit
3,854,407 A * 12/1974 Cocroft ..... 104/112
5,213,045 A 5/1993 Gersemsky
5,228,961 A * 7/1993 Sakai ..... 204/471
5,419,260 A * 5/1995 Hamilton ..... 104/89
6,840,393 B2 * 1/2005 Tu ..... 212/328

FOREIGN PATENT DOCUMENTS

EP 0620179 B1 6/1998

OTHER PUBLICATIONS

European Search Report completed Jan. 31, 2006, from corresponding European Application No. EP 04 02 2510.

* cited by examiner

*Primary Examiner*—S. Joseph Morano
*Assistant Examiner*—Robert J. McCarry, Jr.
(74) *Attorney, Agent, or Firm*—Van Dyke, Gardner, Linn & Burkhart, LLP

(57) ABSTRACT

A crane trolley, especially a single-rail trolley with a short overall height, with a traveling mechanism frame (2) having a hoisting mechanism (1), which can travel by running wheels (3, 3*a*) on a rail, especially a lower flange (4*a*) of an essentially horizontal beam (4), wherein at least one running wheel (3*a*) can be driven, and a friction roller (10) interacting with the driven running wheel (3*a*) is arranged on the underside (4*b*) of the rail. In order to create a crane trolley that guarantees a reliable reduction in the slippage of the driven running wheel (3*a*) with a simple design, a pair of friction rollers (10) is provided, which may be positioned against the underside (4*b*) of the rail by adjusting the spacing from each other via a common pressing mechanism.

21 Claims, 3 Drawing Sheets

CRANE TROLLEY WITH LOW OVERALL HEIGHT

BACKGROUND OF THE INVENTION

The invention concerns a crane trolley, particularly one with a short overall height. The invention is particularly useful with a single-rail trolley having a running gear frame having a hoisting mechanism, which can travel by running wheels on a rail. The invention is illustrated with a crane trolley having a lower flange of an essentially horizontally situated beam, with at least one running wheel being driven, and on the underside of the rail is arranged a friction roller interacting with the driven running wheel.

In crane trolleys with short overall height, in order to accomplish a compact and space-saving construction, the hoisting mechanism is arranged at the side, next to the beam carrying the rail, so that the actual load lifting tackle—the load hook—can be lifted as high as possible underneath the beam. This arrangement of the hoisting mechanism next to the beam produces an off-center position of the center of gravity of the running gear frame relative to the center of the beam. Due to this off-center shifting of the center of gravity, there is a risk when operating without a payload that the running wheels arranged on the rail, especially the lower flange of a beam, will lift up relative to the hoisting mechanism.

Such lifting should be avoided in order to prevent damage to the crane trolley and/or beam and avoid a slippage of the driven running wheels.

Various solutions are known from practice for solving this problem. One variant is to arrange a counterweight on the side of the running gear frame opposite the hoisting mechanism, so as displace the center of gravity back to the middle of the beam. A counterweight, on the one hand, takes up additional space, and on the other hand the proper weight of the crane trolley and the load on the beam is needlessly increased.

Generic crane trolleys are known from DE 42 09 565 C2 and EP 0 620 179 B1, in which a friction roller interacting with at least one driven running wheel is arranged on the underside of the lower flange. This likewise driven friction roller can be forced by a spring mechanism against the underside of the lower flange, in order to increase the traction of the driven running wheel.

These designs used in familiar driven friction rollers are often cumbersome and take up space, due to the drive unit of the friction roller. Furthermore, the wear behavior of the interacting driven running wheels and friction rollers is normally different, so that the rolling radii change in different ways, which again results in additional slippage of the less loaded wheel.

U.S. Pat. No. 3,212,455 discloses a single-rail crane trolley in which a friction roller can be adjusted on the underside of the traveling rail opposite a running wheel in order to prevent an undesirable tilting. By adjusting a screw, the friction roller can be swiveled in order to adjust the distance between the particular running roller and itself to prevent a tilting depending on the traveling rail.

SUMMARY OF THE INVENTION

The invention provides a crane trolley of the aforementioned kind, which ensures a reliable reduction of the slippage of the driven running wheel with a simple construction.

The solution to this problem is characterized, according to an aspect of the invention, in that a pair of friction rollers is provided, which can be adjusted on the underside of the traveling rail by adjusting the distance from each other with a common pressure mechanism.

Due to configuring the friction roller for increasing the traction as a non-driven friction roller pair, it is possible to make the friction roller design especially light and compact and thus space-saving, since a drive unit for the friction rollers has been eliminated.

In order to make sure that the friction roller pair ensures operation of the driven running wheel regardless of the direction of travel of the trolley, the two friction rollers of each pair of friction rollers may be arranged symmetrically to the axis of rotation of the particular running wheel underneath the running wheel, so that the two friction rollers of a pair of friction rollers always have the same radial load and ensure a uniform pressing of the running wheel against the lower flange of the beam, acting as the traveling rail.

According to one practical embodiment of the invention, it is proposed that each pair of friction rollers can be secured to the running gear frame by a support rod linkage, which preferably comprises two double-arm levers swiveling about a common axis, with a friction roller rotationally mounted at one free end of each lever. This scissors-like design of the support rod linkage is not only especially easy to produce, but also it is very flexible in use, since the distance between the two friction rollers of the pair can be adjusted relative to each other, so that the design can also be used regardless of the thickness of the rail, especially the thickness of the lower flange, and be adapted to it.

According to one embodiment of the invention, the other two free ends of the levers of the support rod linkage are joined together via a spring-loaded pressing mechanism, by which the position of the friction rollers of the pair and their pressing force against the underside of the rail, especially the lower flange, can be adjusted.

The pressing mechanism consists preferably of a screw joining together the two free ends of the levers and a pressure spring that can be placed on the screw and tightened by a nut. Besides the especially simple and economical design of this mechanism, it offers the possibility of adjusting the friction rollers continuously in broad limits and varying the pressing force by choice of the spring length and characteristics.

Furthermore, it is proposed that the support rod linkage of each pair of friction rollers can be fastened on a cross arm arranged on the running gear frame transverse to the direction of travel. Since the cross arms are preferably cross arms that join together the parts of the running gear frame arranged to the right and left of the beam, the installation of the support rod linkage carrying the pair of friction rollers requires no additional structural parts that would not be necessary if the pair of friction rollers were not installed.

According to a first embodiment of the invention, the positioning of the support rod linkage on the cross arm is done by a spacing tube which can be placed on the cross arm.

In a second embodiment of the invention, the support rod linkage is positioned precisely on the cross arm by a set collar which can be secured to the cross arm, for example, by means of a threaded pin or a stud screw.

Finally, it is proposed that a pair of non-driven friction rollers may be arranged underneath all running wheels, which are arranged in a row with the at least one driven running wheel in the direction of travel.

Further features and benefits of the invention are described by means of the enclosed drawings, which show two sample embodiments of the invented crane trolley only as examples.

DESCRIPTION OF THE PREFERRED EMBODIMENT

Figure 1:
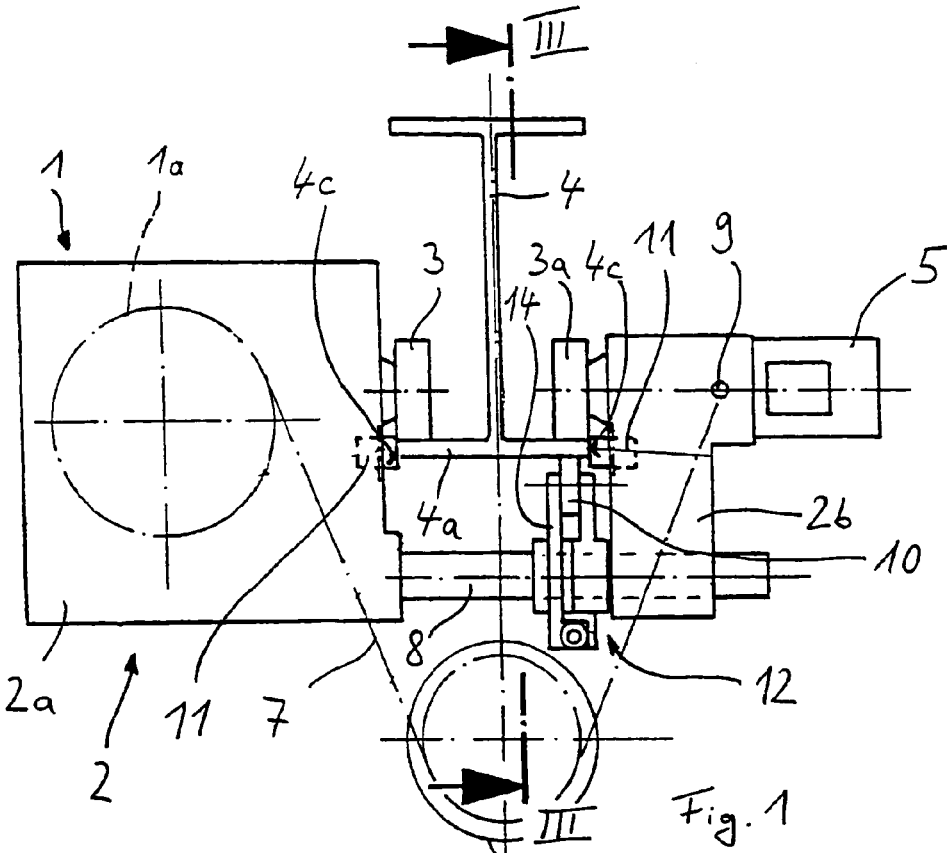
FIG. 1 is a front view of a crane trolley, according to the invention.
Figure 2:
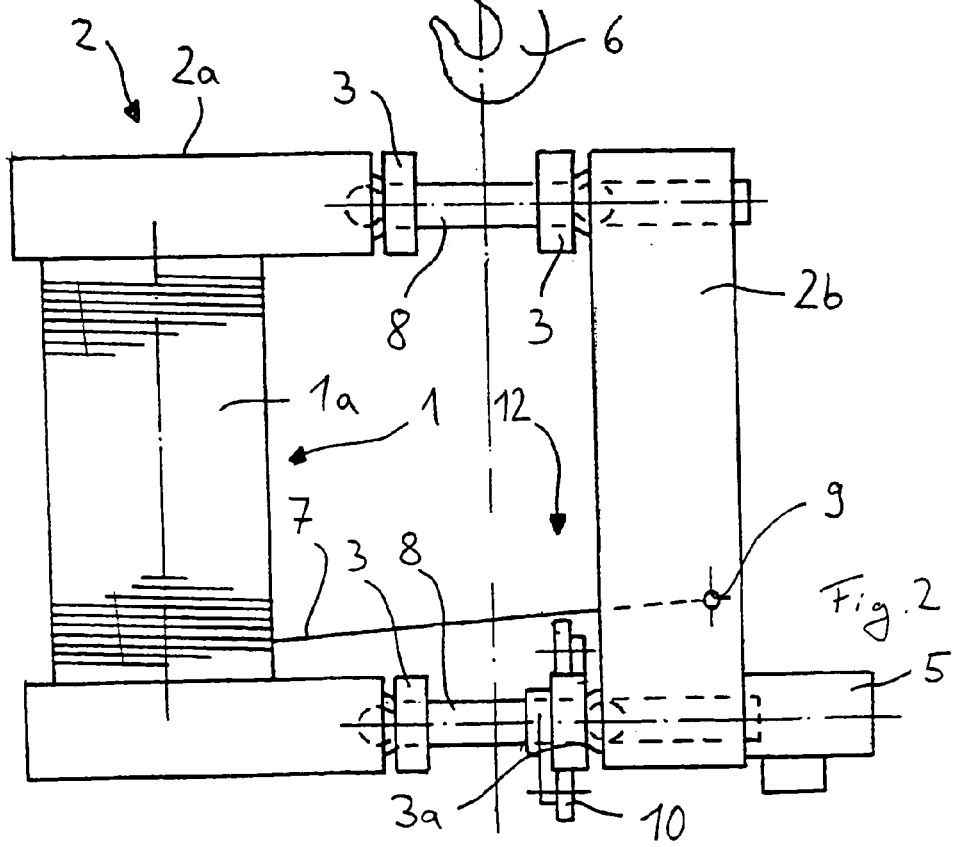
FIG. 2 is a top view of the crane trolley of FIG. 1, with the beam removed to reveal additional details thereof.

Referring now to the drawings and the illustrative embodiments depicted therein, a crane trolley represented in front view and top view in FIGS. 1 and 2 basically consists of a running mechanism frame 2, containing a hoisting mechanism 1, which can travel by four running wheels 3, 3*a* along a traveling rail, configured as a lower flange 4*a*, of an essentially horizontally positioned I-beam 4, wherein one running wheel 3*a* is driven by a traveling mechanism 5. As an alternative to driving only one running wheel 3*a*, several running wheels can also be driven by the one traveling mechanism 5 or separate mechanisms for each. The crane trolley can also be used in connection with other beams, such as box girders, as long as the traveling rail has a cross section having opposite traveling surfaces for the running wheels 3, 3*a* and the friction rollers 10 to be described hereafter.

In order to be able to lift a load hook 6 via a cable pulley block 7 by means of the hoisting mechanism 1 as high as possible underneath the beam 4, the traveling mechanism frame 2 of the illustrated single-rail trolley has an especially low overall height. This low overall height is achieved in that the traveling mechanism frame 2 is formed from two frame pieces 2*a* and 2*b*, which are arranged on either side next to the beam 4. The two frame pieces 2*a* and 2*b* of the traveling mechanism frame 2 are joined rigidly together via cross arms 8 running transverse to the direction of travel of the trolley. The hoisting unit, consisting of a cable drum 1*a* of the hoisting mechanism 1 and a reeving part 9, which contains for example a cable end fastening, is arranged so that the load hook 6 guided on the cable pulley block 7 is positioned perpendicular beneath the vertical axis of the beam 4, in order to minimize strain on the beam 4.

Besides the represented use of a cable pulley block 7, it is of course also possible to operate the hoisting mechanism 1 with a chain pulley block.

The arrangement of the traveling mechanism frame 2 at the side next to the beam 4 produces a position of the center of gravity of the traveling mechanism frame 2 that is shifted off-center—relative to the middle of the beam 4—toward the frame piece 2*a* containing the hoisting mechanism 1. This displacement of the center of gravity can have the effect that, when the trolley is operating without payload, the running wheels 3 arranged opposite the hoisting mechanism 1 and especially the driven running wheel 3*a* will lift up and/or slip.

In order to prevent such a lifting or slippage, especially for the driven running wheel 3*a*, in the embodiment depicted there is arranged beneath the driven running wheel 3*a* a pair of friction rollers, consisting of two friction rollers 10, interacting with the driven running wheel 3*a* and resting against the underside 4*b* of the traveling rail, fashioned as a lower flange 4*a*. The construction and the mode of operation of the pair of friction rollers shall be explained more closely hereafter by FIGS. 3 and 4.

In order to stabilize the straight running of the trolley, four guide rollers 11 are furthermore mounted in the vicinity of the running wheels 3, 3*a*, able to turn about the vertical on the frame pieces 2*a* and 2*b* of the traveling mechanism frame 2, which thrust against the outer flanks 4*c* of the lower flange 4*a* of the beam 4, as can be seen in FIG. 1.

Figure 3:
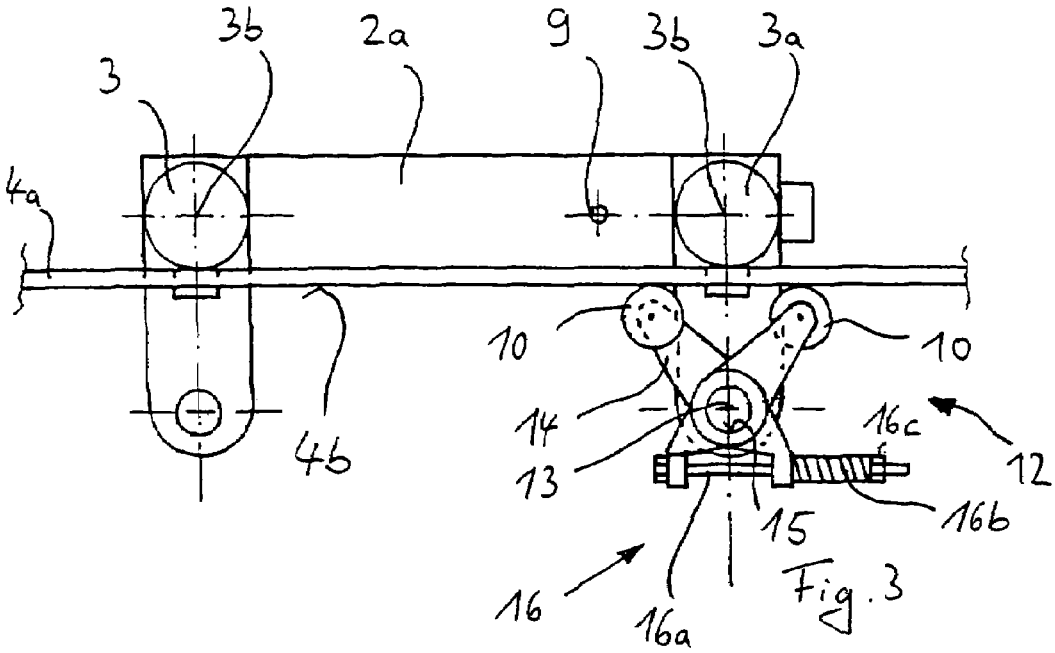
FIG. 3 is a sectional view along line III—III of FIG. 1.
Figure 4:
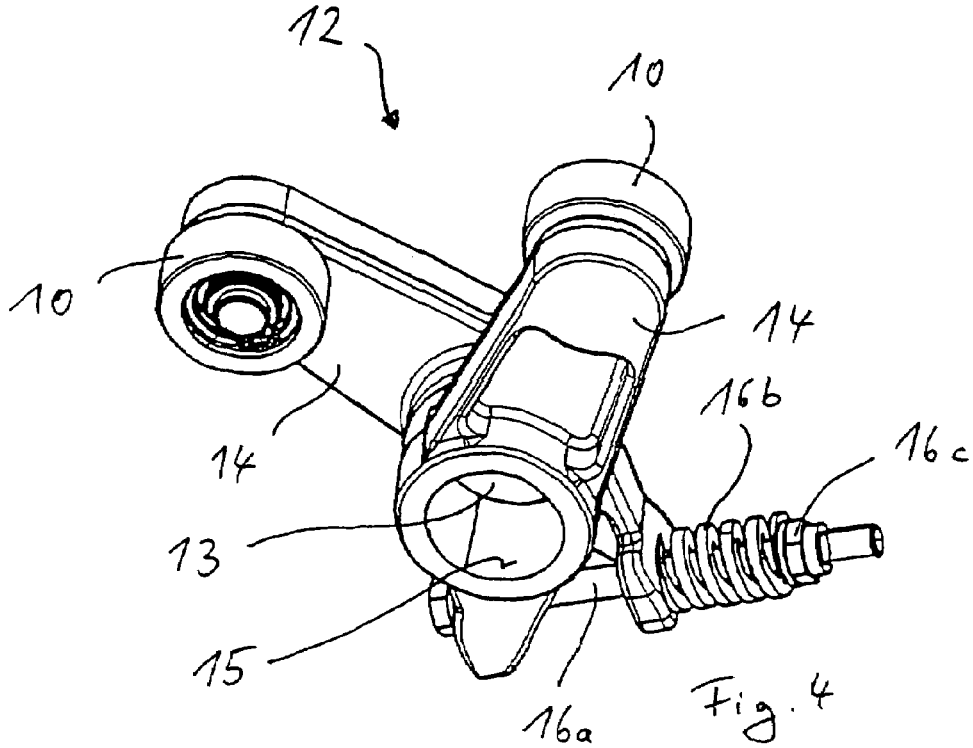
FIG. 4 is a perspective side view of a support rod linkage with pair of friction rollers.

The cross section representation of FIG. 3 and the perspective view of FIG. 4 show the layout of the pair of friction rollers as well as its positioning on the trolley. As can be seen from the figures, the pair of friction rollers can be secured via a support rod linkage 12 on the traveling mechanism frame 2, consisting of two double-arm levers 14 that can swivel about a common axis 13. The two friction rollers 10 of the pair are each mounted so that they can rotate at one free end of either lever 14 of the scissors-like linkage 12.

In order to secure the linkage 12 on the traveling mechanism frame 2, the levers 14 have a borehole 15 in the region of the swivel axis 13, by which the linkage 12 can be pivoted on one of the cross arms 8, which join the two frame pieces 2*a* and 2*b* together. In the embodiment depicted, the linkage 12 is mounted on the front cross arm 8 in FIG. 2 and positioned, as can be seen from FIGS. 2 and 3, so that it is arranged centrally beneath the driven running wheel 3*a*, and the two friction rollers 10 of the pair are arranged symmetrically to the axis of rotation 3*b* of the traveling wheel 3*a*.

The positioning of the linkage 12 on the cross arm 8 is an especially advantageous design, since no additional structural parts are required for the mounting of the linkage 12 that would not be necessary if the linkage 12 were omitted.

In order to bring the friction rollers 10 of the pair to bear against the underside 4*b* of the lower flange 4*a* and in this way also press the driven running wheel 3*a* by its running surface against the lower flange 4*a*, the free ends of the lever 14 placed opposite the friction rollers 10 are joined together by an adjusting mechanism, such as a pressing mechanism 16. Activating this pressing mechanism 16 brings about a mutual swiveling of the levers 14 relative to each other and thus an adjusting of the spacing between the friction rollers 10.

In the embodiment depicted in FIGS. 3 and 4, the pressing mechanism 16 consists of a screw 16*a* that joins together the two free ends of the lever 14, a helical compression spring 16*b* that can be placed on the screw 16*a*, and a nut 16*c* that can be screwed onto the screw 16*a* and is used to compress and release the spring 16*b*.

Figure 5:
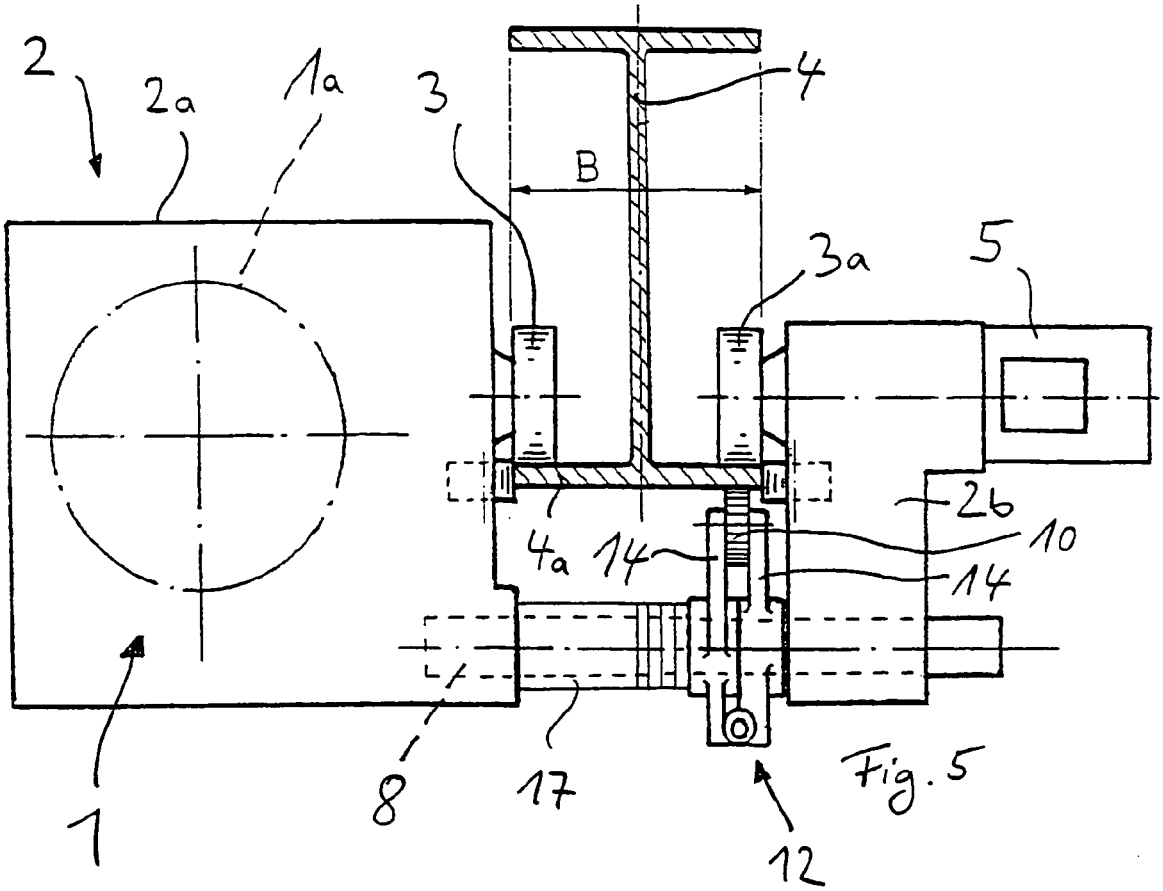
FIG. 5 is the same view as FIG. 1, showing a first embodiment for the positioning of the support rod linkage.
Figure 6:
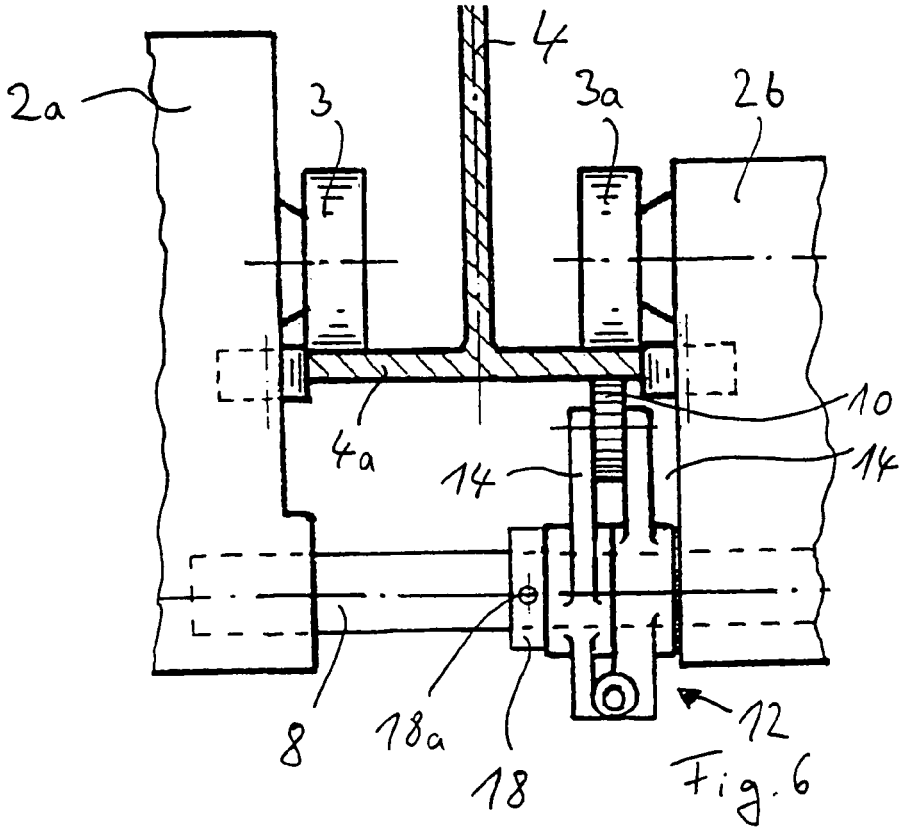
FIG. 6 is an enlarged view of a portion of FIG. 5, but representing a second embodiment for the positioning of the support rod linkage.

FIGS. 5 and 6 show two variants of how the support rod linkage 12 can be positioned exactly underneath the driven running wheel 4*a* on the cross arm 8. In the first embodiment shown in FIG. 5, the positioning of the linkage 12 occurs by a spacer tube 17 which can be placed on the cross arm 8, thrusting against the frame piece 2*a* at one end and against the levers 14 of the linkage 12 at the other end.

According to the second embodiment depicted in FIG. 6, the support rod linkage 12 is positioned by a set collar 18 that can be placed on the cross arm 8 and bears against the linkage 12, and the set collar 18 can be locked on the cross arm 8 by a threaded pin 18*a*, for example, or a stud screw 18*a*.

With the help of the spacer tube 17 or the set collar 18, the position of the support rod linkage 12 can be chosen freely according to the width B of the lower flange 4*a* of the beam 4, but it will preferably be adjusted so that the friction rollers 10 are arranged centrally beneath the driven running wheel 3*a*.

Besides using only one pair of friction rollers that is arranged exclusively beneath the driven running wheel 3*a*, it is also possible, of course, to arrange pairs of friction rollers beneath several running wheels 3, especially beneath all running wheels 3 on the part of the lower flange 4*a* of the beam 4 that lies opposite the frame piece 2*a* containing the hoisting mechanism 1, since these running wheels 3 have the greatest danger of lifting off and/or slipping because of the shifting of the center of gravity.

The adjustment of the friction rollers 10 of the pair using the pressing mechanism 16 is done as follows:

The friction rollers 10 bearing against the underside 4*b* of the lower flange 4*a* counteract the tendency of individual running wheels 3, 3*a* to lift off from the lower flange when operating without a payload, due to the shifting of the center of gravity of the traveling mechanism frame 2.

Depending on the mass of the trolley itself and the width B of the lower flange 4*a* of the beam 4, the compression spring 16*b* of the pressing mechanism 16 will be more or less loaded. By turning the nut 16*c* on the screw 16*a*, the compression spring 16*b* is further shortened until the driven running wheel 3*a* arranged above the support rod linkage 12 makes contact by its running surface with the lower flange 4*a* of the beam 4. This is the zero position of the radial load of the driven running wheel 3*a*.

Now, in order to produce a radial load on the driven running wheel 3*a* that is sufficient to propel the trolley without a payload and thus avoid a slippage, the compression spring 16*b* is further tightened until the driven running wheel 3*a* no longer slips upon acceleration of the traveling mechanism 5. In this position, the compression spring 16*b* of the pressing mechanism 16 still has sufficient distance from the maximum stress position to avoid a slippage by further tightening, even when the running surface of the lower flange 4*a* is wet or oily.

The length and characteristic of the compression spring 16*b* can be chosen so that the support rod linkage 12 and thus the pair of friction rollers can be adjusted to conventional flange thicknesses.

The above-specified crane trolley is distinguished in that the arrangement of the friction rollers is very compact, space-saving, and easily installed.

Furthermore, in combination with a frequency-regulated traveling mechanism 5, the run-up torque and thus the starting acceleration can be regulated and limited to a justifiable extent, which can considerably reduce the size of the radial load on the driven running wheel 3*a* as compared to solutions without frequency converter.

Changes and modifications in the specifically described embodiments can be carried out without departing from the principles of the invention which is intended to be limited only by the scope of the appended claims, as interpreted according to the principles of patent law including the doctrine of equivalents.

The embodiments of the invention in which an exclusive property or privilege is claimed are defined as follows:

1. A crane trolley, comprising:

a traveling mechanism frame having a hoisting mechanism, said traveling mechanism adapted to travel by running wheels on a rail, wherein at least one of said running wheels comprises a driven running wheel;

at least one friction roller interacting with said driven running wheel, said at least one friction roller being arranged on the underside of said rail; and wherein said at least one friction roller comprises a pair of friction rollers, said pair of friction rollers adapted to be positioned against the underside of said rail by adjusting the spacing of the rollers relative to each other via a common adjusting mechanism acting on both said pair of friction rollers such that each said friction roller of said pair of friction rollers has substantially the same radial load;

wherein said pair of friction rollers is arranged symmetrically with respect to an axis of rotation of one of said running wheels underneath that running wheel, wherein said pair of friction rollers is secured to said traveling mechanism frame by two double-arm levers that can swivel about a common axle, and one of said friction rollers is mounted to turn at one free end of each of said levers, wherein the other two free ends of said levers are joined together by a spring-loaded adjusting mechanism;

wherein said adjusting mechanism comprises a screw joining together the two free ends of said levers and a compression spring which can be placed an the screw and tightened by a nut.

2. The crane trolley of claim 1, wherein said levers of said pair of friction rollers are adapted to be secured to a cross arm arranged transverse to the direction of travel on said traveling mechanism frame.

3. The crane trolley of claim 2, wherein said levers are adapted to be positioned on said cross arm by a spacer tube that can be placed on said cross arm.

4. The crane trolley of claim 3, including at least two pair of friction rollers, each of said at least two pair of friction rollers underneath each of said running wheels and being arranged in a row with the at least one driven running wheel in the direction of travel.

5. The crane trolley of claim 2, wherein said levers can be positioned on said cross arm by a set collar which is adapted to be secured to said cross arm.

6. The crane trolley of claim 5, including at least two pair of friction rollers, each of said at least two pair of friction rollers underneath each of said running wheels and being ranged in a row with the at least one driven running wheel in the direction of travel.

7. The crane trolley of claim 1, including at least two pair of friction rollers, each of said at least two pair of friction rollers underneath each of said running wheels and being arranged in a row with the at least one driven running wheel in the direction of travel.

8. The crane trolley of claim 1 comprising a single-rail trolley.

9. The crane trolley of claim 1, wherein said hoisting mechanism travels on a lower flange of said rail.

10. A crane trolley, comprising:

a traveling mechanism frame having a hoisting mechanism, said traveling mechanism adapted to travel by running wheels on a rail, wherein at least one of said running wheels comprises a driven running wheel;

at least one friction roller interacting with said driven running wheel, said at least one friction roller being arranged on the underside of said rail; and wherein said at least one friction roller comprises a pair of friction rollers, said pair of friction rollers adapted to be positioned against the underside of said rail by adjusting the spacing of the rollers relative to each other via a common adjusting mechanism acting on both said pair of friction rollers such that each said friction roller of said pair of friction rollers has substantially the same radial load;

wherein said pair of friction rollers is secured to said traveling mechanism frame by two double-arm levers that can swivel about a common axle, and one of said friction rollers is mounted to turn at one free end of each of said levers, and wherein the other two free ends of said levers are joined together by a spring-loaded adjusting mechanism.

wherein said adjusting mechanism comprises a screw joining together the two free ends of said levers and a compression spring which can be placed on the screw and tightened by a nut.

11. The crane trolley of claim 10, wherein said levers of said pair of friction rollers are adapted to be secured to a cross arm arranged transverse to the direction of travel on said traveling mechanism frame.

12. The crane trolley of claim 11, wherein said levers are adapted to be positioned on said cross arm by a spacer tube that can be placed on said cross arm.

13. The crane trolley of claim 12, including at least two pair of friction rollers, each of said at least two pair of friction rollers underneath each of said running wheels and being arranged in a row with the at least one driven running wheel in the direction of travel.

14. The crane trolley of claim 11, wherein said levers can be positioned on said cross arm by a set collar which is adapted to be secured to said cross arm.

15. The crane trolley of claim 14, including at least two pair of friction rollers, each of said at least two pair of friction rollers underneath each of said running wheels and being arranged in a row with the at least one driven running wheel in the direction of travel.

16. The crane trolley of claim 10, wherein said levers of said pair of friction rollers are adapted to be secured to a cross arm arranged transverse to the direction of travel on said traveling mechanism frame.

17. The crane trolley of claim 16, wherein said levers are adapted to be positioned on said cross arm by a spacer tube that can be placed on said cross arm.

18. The crane trolley of claim 17, including a nondriven pair of friction rollers underneath each of said running wheels being arranged in a row with the at least one driven running wheel in the direction of travel.

19. The crane trolley of claim 16, wherein said levers can be positioned on said cross arm by a set collar which is adapted to be secured to said cross arm.

20. The crane trolley of claim 19, including a nondriven pair of friction rollers underneath each of said running wheels being arranged in a row with the at least one driven running wheel in the direction of travel.

21. The crane trolley of claim 10, including at least two pair of friction rollers, each of said at least two pair of friction rollers underneath each of said running wheels and being arranged in a row with the at least one driven running wheel in the direction of travel.

* * * * *

UNITED STATES PATENT AND TRADEMARK OFFICE

CERTIFICATE OF CORRECTION

PATENT NO. : 7,234,400 B2
APPLICATION NO. : 10/945583
DATED : June 26, 2007
INVENTOR(S) : Winter et al.

It is certified that error appears in the above-identified patent and that said Letters Patent is hereby corrected as shown below:

Column 6
Claim 1, Line 31, “an” should be --on--
Claim 6, Line 51, “ranged” should be --arranged--

Column 7
Claim 10, Line 18, “mechanism.” should be --mechanism;--

Signed and Sealed this
Twenty-second Day of January, 2013

David J. Kappos

David J. Kappos
*Director of the United States Patent and Trademark Office*